US011626259B1

(12) United States Patent
Tsai et al.

(10) Patent No.: US 11,626,259 B1
(45) Date of Patent: Apr. 11, 2023

(54) MEMBRANE CIRCUIT STRUCTURE

(71) Applicant: Primax Electronics Ltd., Taipei (TW)

(72) Inventors: Lei-Lung Tsai, Taipei (TW); Sheng-Fan Chang, Taipei (TW); Chin-Sung Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/703,320

(22) Filed: Mar. 24, 2022

(30) Foreign Application Priority Data

Feb. 25, 2022 (TW) ..... 111107181

(51) Int. Cl.
*H01H 1/06* (2006.01)

(52) U.S. Cl.
CPC ..... *H01H 1/06* (2013.01)

(58) Field of Classification Search
CPC ..... H01H 1/403; H01H 1/06; H01H 13/702; H01H 13/703; H01H 13/14; H01H 13/86; H01H 13/82; H01H 13/88; H01H 13/704; H01H 13/705; H01H 13/7057; H01H 2209/00; H01H 2211/00; H01H 2227/004; H01H 2227/006; H01H 2227/024
USPC ..... 200/344, 512, 514, 522, 269, 270, 292, 200/5 A
See application file for complete search history.

(56) References Cited

U.S. PATENT DOCUMENTS

| | | | | |
|---|---|---|---|---|
| 6,762,380 | B2 * | 7/2004 | Nelson | H01H 13/702 174/250 |
| 8,212,162 | B2 * | 7/2012 | Zhou | H01H 13/7057 200/5 A |
| 10,153,104 | B1 * | 12/2018 | Tsai | H01H 13/705 |
| 10,388,472 | B2 * | 8/2019 | Zhang | H01H 13/7057 |
| 10,444,856 | B1 * | 10/2019 | Wang | H01H 13/83 |
| 11,048,336 | B2 * | 6/2021 | Lin | G06F 3/0202 |
| 11,099,656 | B1 * | 8/2021 | Chen | H01H 13/85 |
| 2003/0122691 | A1 * | 7/2003 | Olodort | G06F 3/0221 341/22 |
| 2011/0056817 | A1 * | 3/2011 | Wu | H01H 13/88 200/344 |
| 2014/0339066 | A1 * | 11/2014 | Liang | H03K 17/975 200/600 |
| 2015/0311012 | A1 * | 10/2015 | Wada | H10N 30/302 200/514 |

* cited by examiner

*Primary Examiner* — William A Bolton
(74) *Attorney, Agent, or Firm* — Kirton McConkie; Evan R. Witt

(57) ABSTRACT

A membrane circuit structure having a plurality of switch regions includes first, second and third membranes and a spacer layer. The second membrane is beneath the first membrane, and a lower surface of the second membrane is provided with a conductive pattern in at least one of the switch regions. The spacer layer is disposed between the first and second membranes. The third membrane is beneath the second membrane, and an upper surface of the third membrane is provided with first and second trigger portions separated from each other in the at least one of the switch regions, and the conductive pattern is able to be in contact with the first and second trigger portions, so that the first and second trigger portions are able to be electrically connected to each other through the conductive pattern.

10 Claims, 3 Drawing Sheets

MEMBRANE CIRCUIT STRUCTURE

FIELD OF THE INVENTION

The present invention relates to a membrane circuit structure, and more particularly, to a membrane circuit structure that does not include any jumper.

BACKGROUND OF THE INVENTION

Since there are a large number of mechanical holes (or membrane through holes) in an existing membrane circuit structure and thus a region for circuit layout is limited, a plurality of jumpers are needed in the circuit layout. Please refer to FIG. 1, which is a schematic diagram of a conventional membrane circuit layout. The membrane circuit layout has mechanical holes 10*m*, and there is a jumper 20 disposed at an intersection of a wire 11 with a plurality of wires 12 to electrically isolate the wire 11 and the wires 12 from each other. However, a manufacturing process of the jumper 20 is complicated, and if quality of an insulating layer between upper and lower wires (which is used to electrically isolate the upper and lower wires) is not good, a short circuit between the wires will occur. In addition, the jumper 20 may increase a local thickness of the membrane circuit structure, so that the thickness of the membrane circuit structure is not uniform. Therefore, there is an urgent need for a membrane circuit structure that does not include any jumper.

In another aspect, please refer to FIG. 1, a waterproof adhesive (not shown) is usually provided around the mechanical holes 10*m*, so that the membrane circuit structure has waterproof performance. However, due to the large number of the wires 11 and 12 and the use of the jumpers 20, a distributable region (i.e. a distributable area or a distributable width) of the waterproof adhesive is very small, so the membrane circuit structure has poor waterproof performance.

SUMMARY OF THE INVENTION

The present invention provides a membrane circuit structure, which has a plurality of switch regions, and the membrane circuit structure includes a first membrane, a second membrane, a spacer layer and a third membrane. The second membrane is disposed beneath the first membrane, and a lower surface of the second membrane is provided with a conductive pattern in at least one of the switch regions. The spacer layer is disposed between the first membrane and the second membrane. The third membrane is disposed beneath the second membrane, and an upper surface of the third membrane is provided with a first trigger portion and a second trigger portion separated from each other in the at least one of the switch regions. The conductive pattern is able to be in contact with the first trigger portion and the second trigger portion, so that the first trigger portion and the second trigger portion are able to be electrically connected to each other through the conductive pattern.

In some embodiments, the membrane circuit structure does not include a jumper.

In some embodiments, a lower surface of the first membrane is provided with an upper trigger portion in another of the switch regions, and an upper surface of the second membrane is provided with a lower trigger portion in the other of the switch regions, and the spacer layer has a through hole, and the upper trigger portion is able to be in contact with the lower trigger portion through the through hole, so that the upper trigger portion and the lower trigger portion are able to be electrically connected to each other.

In some embodiments, the membrane circuit structure further includes an anisotropic conductive material, in which the membrane circuit structure further has a circuit connection region close to one of the switch regions, and a lower surface of the first membrane is provided with a first wire in the circuit connection region, and the upper surface of the third membrane is provided with a second wire in the circuit connection region, and the spacer layer has a first opening, and the second membrane has a second opening substantially aligned with the first opening, and the anisotropic conductive material is disposed in the first opening and the second opening, and the first wire and the second wire are electrically connected to each other through the anisotropic conductive material.

In some embodiments, the membrane circuit structure further includes another anisotropic conductive material, in which an upper surface of the second membrane is provided with a third wire in the circuit connection region, and the spacer layer has a third opening separated from the first opening, and the other anisotropic conductive material is disposed in the third opening, and the first wire and the third wire are electrically connected to each other through the other anisotropic conductive material.

In some embodiments, the first trigger portion is a first U-shaped pattern.

In some embodiments, the second trigger portion is a second U-shaped pattern.

In some embodiments, in a top view an end of the first U-shaped pattern is inserted into an opening of the second U-shaped pattern.

In some embodiments, an edge of the conductive pattern is misaligned with an edge of the first trigger portion that is closest to the edge of the conductive pattern, and another edge of the conductive pattern is misaligned with an edge of the second trigger portion that is closest to the other edge of the conductive pattern.

In some embodiments, a sum of a width of the first trigger portion and a width of the second trigger portion is greater than a width of the conductive pattern.

BRIEF DESCRIPTION OF THE DRAWINGS

Aspects of the present invention are best understood from the following embodiments, read in conjunction with accompanying drawings. However, it should be understood that in accordance with common practice in the industry, various features have not necessarily been drawn to scale. Indeed, shapes of the various features may be suitably adjusted for clarity, and dimensions of the various features may be arbitrarily increased or decreased.

DETAIL DESCRIPTION OF THE PREFERRED EMBODIMENT

Figure 1:
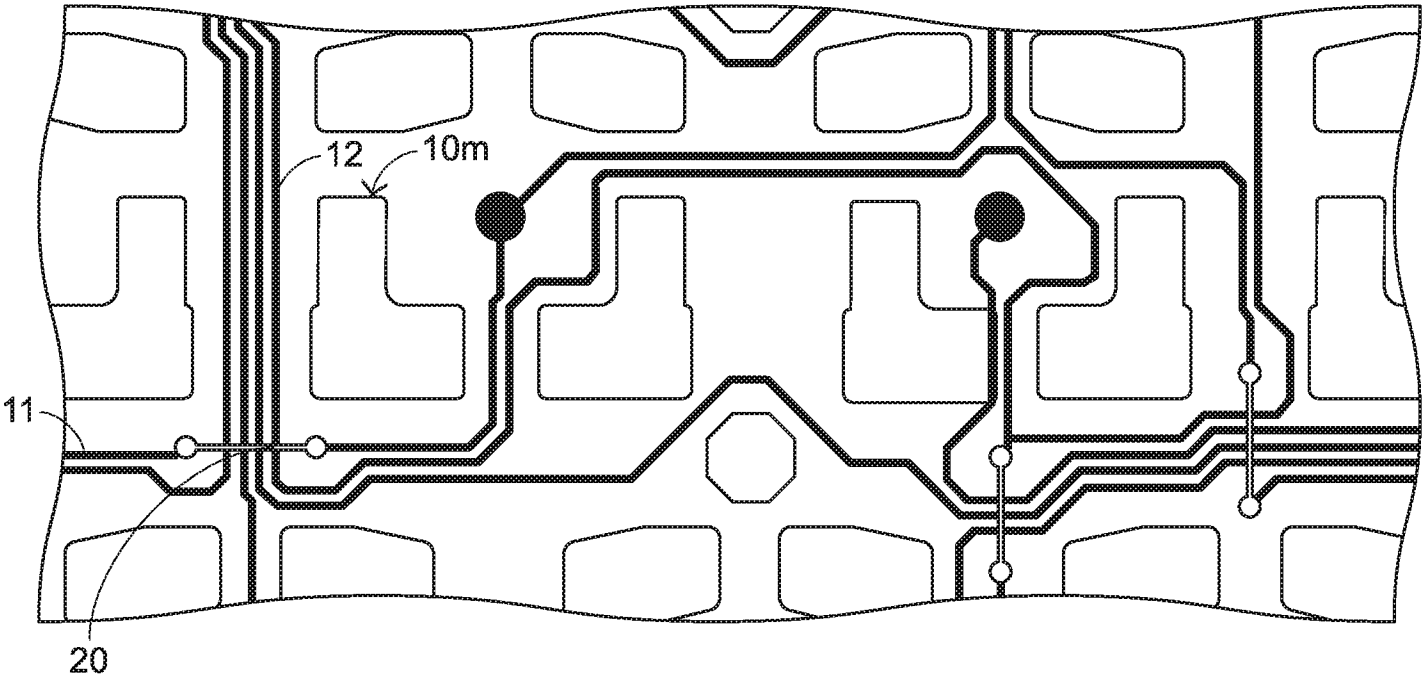
FIG. 1 is a schematic diagram of a conventional membrane circuit layout.

The advantages and features of the present invention and the method for achieving the same will be described in more detail with reference to exemplary embodiments and accompanying drawings to make it easier to understand. However, the present invention can be implemented in different forms and should not be construed as being limited to the embodiments set forth herein. On the contrary, for those skilled in the art, the provided embodiments will make this disclosure more thorough, comprehensive and complete to convey the scope of the present invention.

The spatially relative terms in the text, such as "beneath" and "over", are used to facilitate the description of the relative relationship between one element or feature and another element or feature in the drawings. The true meaning of the spatially relative terms includes other orientations. For example, when the drawing is flipped up and down by 180 degrees, the relationship between the one element and the other element may change from "beneath" to "over." The spatially relative descriptions used herein should be interpreted the same.

As mentioned in background of the invention, the existing membrane circuit structure has jumpers, which makes the manufacturing process more complicated, and the membrane circuit structure has problems such as a nonuniform thickness and insufficient waterproof performance. Therefore, there is currently a need for a membrane circuit structure that does not include any jumper. Accordingly, the present invention provides a membrane circuit structure that does not include any jumper to solve the above problems. Various embodiments of the membrane circuit structure of the present invention will be described in detail below.

Figure 2:
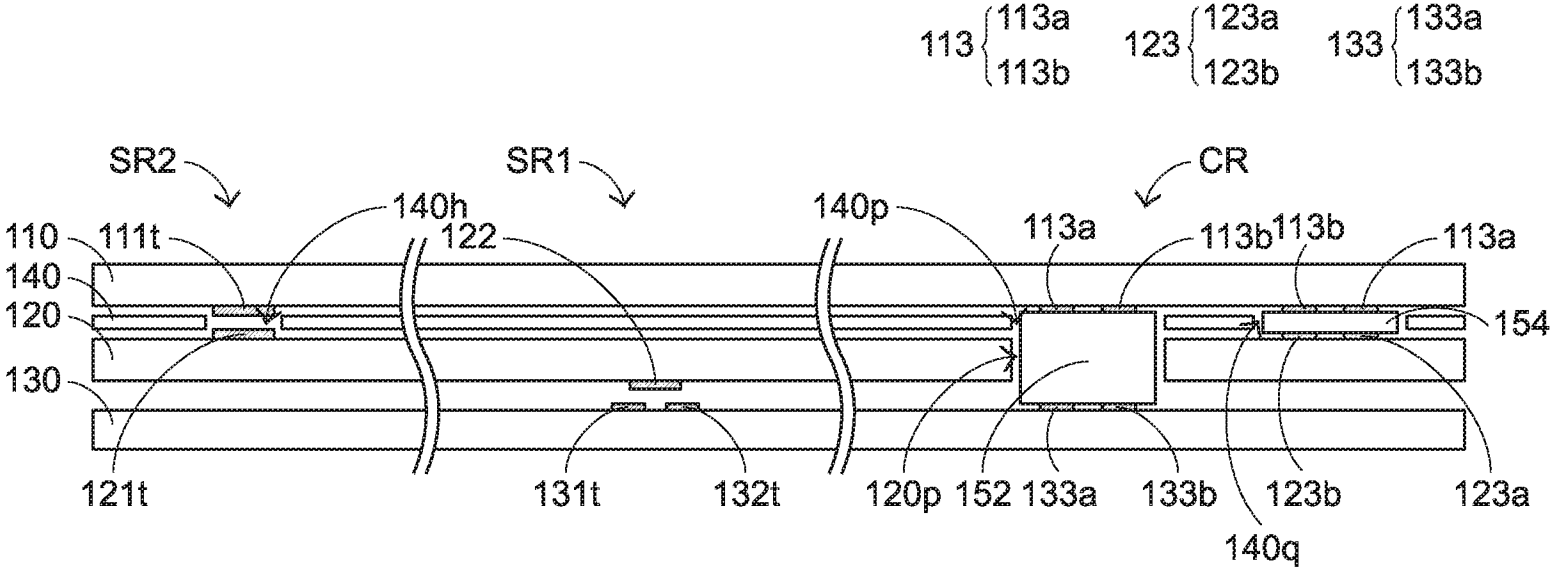
FIG. 2 is a schematic cross-sectional view of a membrane circuit structure according to an embodiment of the present invention.

The membrane circuit structure of the present invention can be applied to a keyboard structure, such as a keyboard structure of a notebook. The membrane circuit structure has a plurality of switch regions, and each of the switch regions can correspond to a key structure. FIG. 2 is a schematic cross-sectional view of a membrane circuit structure according to an embodiment of the present invention. FIG. 2 illustrates two switch regions as an example. As shown in FIG. 2, the membrane circuit structure has switch regions SR1 and SR2.

Please continue to refer to FIG. 2, the membrane circuit structure includes a first membrane 110, a second membrane 120, a third membrane 130 and a spacer layer 140. The first membrane 110, the second membrane 120, the third membrane 130 and the spacer layer 140 may be made of a plastic material, such as polycarbonate (PC), polyethylene terephthalate (PET), polymethyl methacrylate (PMMA), polyurethane (PU) or polyimide (PI). The membrane made of the plastic material has characteristics of insulation, heat resistance, bendability and high resilience, so that the fabricated membrane circuit structure has flexibility, which is similar to a conventional flexible printed circuit (FPC).

Please continue to refer to FIG. 2, the second membrane 120 is substantially parallel to the first membrane 110 and is disposed beneath the first membrane 110. A lower surface of the second membrane 120 is provided with a conductive pattern 122 in at least one of the switch regions (i.e., the switch region SR1). The conductive pattern 122 may be formed by printing a conductive silver paste, but the invention is not limited thereto.

The spacer layer 140 is substantially parallel to the first membrane 110 and the second membrane 120, and is disposed (or can be said to be sandwiched) between the first membrane 110 and the second membrane 120. In some embodiments, a thickness of the spacer layer 140 is smaller than a thickness of the first membrane 110 and a thickness of the second membrane 120.

The third membrane 130 is substantially parallel to the second membrane 120 and the first membrane 110, and is disposed beneath the second membrane 120. An upper surface of the third membrane 130 is provided with a first trigger portion (or may be referred to as a first contact point) 131*t* and a second trigger portion (or may be referred to as a second contact point) 132*t* separated from each other in the at least one of the switch regions (i.e., the switch region SR1). The first trigger portion 131*t*, the second trigger portion 132*t* and their connecting wires may be formed by printing a conductive silver paste, but the invention is not limited thereto.

The conductive pattern 122 is able to be in contact with the first trigger portion 131*t* and the second trigger portion 132*t*, so that the first trigger portion 131*t* and the second trigger portion 132*t* are able to be electrically connected to each other through the conductive pattern 122. Specifically, when a user does not press the button, the first trigger portion 131*t* and the second trigger portion 132*t* are not in contact with the conductive pattern 122 (as shown in FIG. 2); when the user presses the button, the second membrane 120 is squeezed and deformed (e.g., protrudes downwardly), so that the conductive pattern 122 is in contact with the first trigger portion 131*t* and the second trigger portion 132*t*, and thus the first trigger portion 131*t* and the second trigger portion 132*t* are electrically connected to each other through the conductive pattern 122. In some embodiments, one or more of the switch regions in the membrane circuit structure may adopt the structure of the switch region SR1 as shown in FIG. 2.

In some embodiments, a lower surface of the first membrane 110 is provided with an upper trigger portion (or may be referred to as an upper contact point) lilt in another of the switch regions (i.e., the switch region SR2), and an upper surface of the second membrane 120 is provided with a lower trigger portion (or may be referred to as a lower contact point) 121*t* in the other of the switch regions (i.e., the switch region SR2), and the spacer layer 140 has a through hole 140*h*, and the upper trigger portion 111*t* is able to be in contact with the lower trigger portion 121*t* through the through hole 140*h*, so that the upper trigger portion 111*t* and the lower trigger portion 121*t* are able to be electrically connected to each other. Specifically, when a user does not press the button, the upper trigger portion 111*t* and the lower trigger portion 121*t* are not in contact with each other (as shown in FIG. 2); when the user presses the button, the first membrane 110 is squeezed and deformed (e.g., protrudes downwardly), so that the upper trigger portion 111*t* is in contact with and electrically connected to the lower trigger portion 121*t*. In some embodiments, one or more of the switch regions in the membrane circuit structure may adopt the structure of the switch region SR2 as shown in FIG. 2.

It is worth noting that, in practical applications, the design of the switch region SR1 can be used to replace the design of the switch region having the jumper in the existing membrane circuit layout (i.e., the membrane circuit layout with jumpers). Therefore, the design of the switch region SR1 of the present invention can be applied to various existing membrane circuit layouts with jumpers. In particular, it does not take much manpower and time to convert the membrane circuit layout with jumpers to a membrane circuit layout without jumpers.

In another aspect, since one or more of the switch regions in the membrane circuit structure can adopt the structure of the switch region SR1 as shown in FIG. 2, a region that wires arranged on the first membrane 110 and a region that wires arranged on the second membrane 120 can be reduced. As such, a distributable region of a waterproof adhesive disposed around mechanical holes becomes larger, and thus the membrane circuit structure of the present invention can have good waterproof performance.

In some embodiments, as shown in FIG. 2, an edge of the conductive pattern 122 is misaligned with (or offset from) an edge of the first trigger portion 131*t* that is closest to the edge of the conductive pattern 122, and another edge of the conductive pattern 122 is misaligned with (or offset from) an edge of the second trigger portion 132*t* that is closest to the other edge of the conductive pattern 122, but the present invention is not limited thereto. Arrangement positions of the conductive pattern 122, the first trigger portion 131*t* and the second trigger portion 132*t* can be appropriately adjusted according to actual needs.

In some embodiments, as shown in FIG. 2, a sum of a width of the first trigger portion 131*t* and a width of the second trigger portion 132*t* is greater than a width of the conductive pattern 122, but the present invention is not limited thereto. Dimensions of the conductive pattern 122, the first trigger portion 131*t* and the second trigger portion 132*t* can be appropriately adjusted according to actual needs.

In some embodiments, as shown in FIG. 2, the membrane circuit structure further has a circuit connection region CR close to one of the switch regions (e.g., the switch region SR1). In some embodiments, the membrane circuit structure further includes an anisotropic conductive material 152 configured to electrically connect wires on different layers with each other.

For example, as shown in FIG. 2, the lower surface of the first membrane 110 is provided with one or more first wires 113 in the circuit connection region CR (FIG. 2 takes two first wires 113*a* and 113*b* as an example), and the upper surface of the third membrane 130 is provided with one or more second wires 133 in the circuit connection region CR (FIG. 2 takes two second wires 133*a* and 133*b* as an example). The spacer layer 140 has a first opening 140*p*, and the second membrane 120 has a second opening 120*p* substantially aligned with the first opening 140*p*. The anisotropic conductive material 152 is located in the first opening 140*p* and the second opening 120*p*, and the first wires 113 are respectively electrically connected to the second wires 133 through the anisotropic conductive material 152. Specifically, the first wire 113*a* is electrically connected to the second wire 133*a* through the anisotropic conductive material 152, and the first wire 113*b* is electrically connected to the second wire 133*b* through the anisotropic conductive material 152.

It should be noted that FIG. 2 takes the two first wires 113*a* and 113*b* as an example, and there are two portions of the first wire 113*a* and two portions of the first wire 113*b* shown FIG. 2 since FIG. 2 is a cross-sectional view. In some embodiments, the upper surface of the second membrane 120 is provided with one or more third wires 123 in the circuit connection region CR (FIG. 2 takes two third wires 123*a* and 123*b* as an example). The spacer layer 140 has a third opening 140*q* separated from the first opening 140*p*. An anisotropic conductive material 154 is located in the third opening 140*q*, and the first wires 113 are respectively electrically connected to the third wires 123 through the anisotropic conductive material 154. Specifically, the first wire 113*a* is electrically connected to the third wire 123*a* through the anisotropic conductive material 154, and the first wire 113*b* is electrically connected to the third wire 123*b* through the anisotropic conductive material 154.

As can be seen from the above, the second wire 133*a* is electrically connected to the third wire 123*a* through the anisotropic conductive material 152, the first wire 113*a* and the anisotropic conductive material 154; the second wire 133*b* is electrically connected to the third wire 123*b* through the anisotropic conductive material 152, the first wire 113*b* and the anisotropic conductive material 154. That is, the second wires 133*a*, 133*b* can go out through the connection structure shown in FIG. 2, and the third wires 123*a*, 123*b* can be electrically connected with connectors on a system side.

Figure 3:
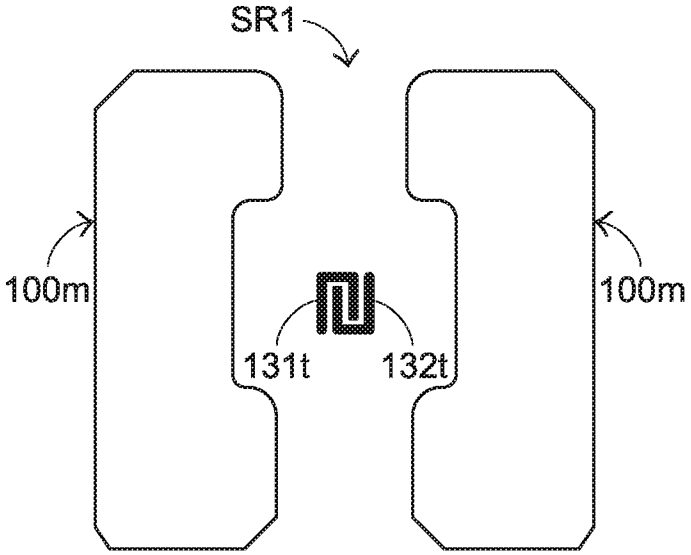
FIG. 3 is a schematic top view of a switch region according to an embodiment of the present invention.

FIG. 3 is a schematic top view of a switch region according to an embodiment of the present invention. As shown in FIG. 3, a switch region SR1 is provided between two mechanical holes 100*m*. In some embodiments, the first trigger portion 131*t* is a first U-shaped pattern. In some embodiments, the second trigger portion 132*t* is a second U-shaped pattern. In some embodiments, in a top view an end of the first U-shaped pattern is inserted into an opening of the second U-shaped pattern, but the present invention is not limited thereto. Shapes of the first trigger portion 131*t* and the second trigger portion 132*t* can be appropriately adjusted according to actual needs.

However, the above are only the preferred embodiments of the present invention, and should not be used to limit the scope of implementation of the present invention, that is, simple equivalent changes and modifications made in accordance with claims and description of the present invention are still within the scope of the present invention. In addition, any embodiment of the present invention or claim does not need to achieve all the objectives or advantages disclosed in the present invention. In addition, the abstract and the title are not used to limit the scope of claims of the present invention.

What is claimed is:

1. A membrane circuit structure having a plurality of switch regions, and the membrane circuit structure comprising:

a first membrane;

a second membrane, disposed beneath the first membrane, and a lower surface of the second membrane being provided with a conductive pattern in at least one of the switch regions;

a spacer layer disposed between the first membrane and the second membrane; and a third membrane, disposed beneath the second membrane, and an upper surface of the third membrane being provided with a first trigger portion and a second trigger portion separated from each other in the at least one of the switch regions, wherein the conductive pattern is able to be in contact with the first trigger portion and the second trigger portion, so that the first trigger portion and the second trigger portion are able to be electrically connected to each other through the conductive pattern.

2. The membrane circuit structure of claim 1, wherein the membrane circuit structure does not include a jumper.

3. The membrane circuit structure of claim 1, wherein a lower surface of the first membrane is provided with an upper trigger portion in another of the switch regions, and an upper surface of the second membrane is provided with a lower trigger portion in the other of the switch regions, and the spacer layer has a through hole, and the upper trigger portion is able to be in contact with the lower trigger portion through the through hole, so that the upper trigger portion and the lower trigger portion are able to be electrically connected to each other.

4. The membrane circuit structure of claim 1, further comprising:

an anisotropic conductive material, wherein the membrane circuit structure further has a circuit connection region close to one of the switch regions, and a lower surface of the first membrane is provided with a first wire in the circuit connection region, and the upper surface of the third membrane is provided with a second wire in the circuit connection region, and the spacer layer has a first opening, and the second membrane has a second opening substantially aligned with the first opening, and the anisotropic conductive material is disposed in the first opening and the second opening, and the first wire and the second wire are electrically connected to each other through the anisotropic conductive material.

5. The membrane circuit structure of claim 4, further comprising:

another anisotropic conductive material, wherein an upper surface of the second membrane is provided with a third wire in the circuit connection region, and the spacer layer has a third opening separated from the first opening, and the other anisotropic conductive material is disposed in the third opening, and the first wire and the third wire are electrically connected to each other through the other anisotropic conductive material.

6. The membrane circuit structure of claim 1, wherein the first trigger portion is a first U-shaped pattern.

7. The membrane circuit structure of claim 6, wherein the second trigger portion is a second U-shaped pattern.

8. The membrane circuit structure of claim 7, wherein in a top view an end of the first U-shaped pattern is inserted into an opening of the second U-shaped pattern.

9. The membrane circuit structure of claim 1, wherein an edge of the conductive pattern is misaligned with an edge of the first trigger portion that is closest to the edge of the conductive pattern, and another edge of the conductive pattern is misaligned with an edge of the second trigger portion that is closest to the other edge of the conductive pattern.

10. The membrane circuit structure of claim 1, wherein a sum of a width of the first trigger portion and a width of the second trigger portion is greater than a width of the conductive pattern.

* * * * *